US005450863A

United States Patent [19]

Collins et al.

[11] Patent Number: 5,450,863

[45] Date of Patent: Sep. 19, 1995

[54] SMOKING ARTICLE WRAPPER AND METHOD FOR MAKING SAME

[75] Inventors: Alfred L. Collins, Powhatan; Billy J. Keen, Jr., Chesterfield; George B. Reid; Renzer R. Ritt, Sr., both of Richmond; William H. Stevens, Midlothian; Howard W. Vogt, Jr., Providence Forge, all of Va.

[73] Assignee: Philip Morris Incorporated, New York, N.Y.

[21] Appl. No.: 74,717

[22] Filed: Jun. 9, 1993

Related U.S. Application Data

[63] Continuation of Ser. No. 853,530, Mar. 18, 1992, abandoned.

[51] Int. Cl.[6] ..... A24D 1/00; A24D 1/12

[52] U.S. Cl. ..... 131/365; 131/358; 131/349; 131/371

[58] Field of Search ..... 131/365, 359, 355, 358, 131/371, 349; 162/139

[56] References Cited

U.S. PATENT DOCUMENTS

| | | | |
|---|---|---|---|
| 2,734,510 | 2/1956 | Hungerford et al. | 131/354 |
| 3,012,915 | 12/1961 | Howard | 131/354 |
| 4,286,605 | 9/1981 | Goslin et al. | 131/354 X |
| 5,152,304 | 10/1992 | Bokelman et al. | 131/365 |

*Primary Examiner*—Vincent Millin
*Assistant Examiner*—William M. Pierce
*Attorney, Agent, or Firm*—Charles E. B. Glenn; James E. Schardt; Kevin B. Osborne

[57] ABSTRACT

A smoking article wrapper comprising a base web material having a first burn rate and one or more regions having a second burn rate is provided. The regions having a second burn rate are comprised of a composite layer structure of: said base web material, a layer is particulate material, and an adhesive layer which adheres to said base web material and to said layer of particular material. The particulate material is subsequently applied to the adhesive layer. An apparatus and method for applying the particulate material onto the base web is also provided.

22 Claims, 7 Drawing Sheets

SMOKING ARTICLE WRAPPER AND METHOD FOR MAKING SAME

This is a continuation of application Ser. No. 07/853,530, filed Mar. 18, 1992, now abandoned.

BACKGROUND OF THE INVENTION

The present invention relates to smoking article wrappers and apparatus and methods for producing them. More specifically, it relates to cigarette wrappers which modify the burn rate of the cigarette and to an apparatus and method for efficiently producing such wrappers in commercial quantities.

It is beneficial to make cigarettes in commercial quantities which will have a reduced burn rate if not drawn on by the smoker but which look, feel, taste and burn like conventional cigarettes when being drawn on by the smoker at normal intervals. It is recognized by those skilled in the art that the wrapper configuration and construction strongly influences these characteristics.

Cigarette wrappers, i.e., papers, have known burn characteristics, including burn rates and static burn capabilities. There have been various attempts to modify the burn characteristics of such wrappers. These attempts have employed a variety of wrapper configurations and constructions.

For example, it is known that the burn characteristics can be modified by adding fillers and burn additives to the papers. Weinert U.S. Pat. No. 4,489,650 describes a cigarette in which the interior surface of the wrapper is coated with clay. In Cohn U.S. Pat. No. 4,044,778 the cigarette wrapper includes rings or areas coated with deposits from an alkali silicate solution which renders the wrapper non-burning in the coated areas. However, none of these wrappers produce cigarettes which look, feel, taste and burn like a conventional cigarette when being drawn on by the smoker at normal intervals.

Durocher U.S. Pat. No. 4,615,345 describes another attempt to modify the burn characteristics of wrappers. In that patent the wrapper was made of a cellulose fiber base which normally does not sustain combustion when the wrapper is incorporated into a cigarette. This type of wrapper was treated in selected zones with an alkali metal burn promoter such as the potassium salt of citric acid.

In addition to modifying wrapper burn characteristics by adding fillers and burn regulators directly to the base paper web, burn characteristics have been shown to be able to be modified by applying to the base paper web a strip or patch of a paper having different characteristics than the base web to be modified. For example, it is shown in co-pending, commonly-assigned U.S. patent application Ser. No. 07/777,466, filed Oct. 17, 1991, that cigarette paper can be modified by applying strips of a different paper at periodically spaced positions across the width of the paper web, so that cigarettes produced from the paper web have periodically spaced circumferential bands on the inside of the paper for modifying the burning characteristics of the paper and the cigarette. One treated paper material suitable for forming the periodically spaced strips is described in Hampl U.S. Pat. No. 4,739,775.

In addition to the various wrapper configurations and constructions discussed above for modifying the burn characteristics, there has been recent interest in providing apparatus and methods for implementing the various wrapper configurations in a commercially feasible manner. This interest is a result of the fact that although a proposed wrapper configuration may fulfill the necessary burn, look, feel and taste characteristics, the apparatus and methods used to produce them may be commercially inefficient. For example, in cigarette making machines where the wrapper is produced "on-line," the base paper web is moving at very high speed. Accordingly, if it is desired to place strips of paper on the web in order to modify the burn characteristics, it is difficult to control the placement of strips of paper on the web. More specifically, it is difficult to align the strips perpendicular to the edge of the base web edge as desired, or to provide the desired spacing between the strips. It also is difficult to assure that the strips are firmly adhered and set before they reach the garniture, so that they do not move during cigarette formation.

As discussed above, various types of cigarette wrapper configurations have been proposed for modifying the burn characteristics of cigarettes. However, these wrappers have various problems and disadvantages. Although the wrappers of Weinert and Cohn produce cigarettes with modified burn characteristics, they do not look, feel, taste and burn like conventional cigarettes. Although the wrappers of Durocher solve some of the problems exhibited by the Weinert and Cohn wrappers, Durocher did not disclose a process for making such cigarette wrappers in commercial quantities. Furthermore, although co-pending application 07/777,466, discloses a method and apparatus which can produce wrappers with both modified burn characteristics and which look, feel, taste and burn like a conventional cigarette when being drawn on by the smoker, such method and apparatus is not the only solution to the problems discussed.

Accordingly, it would be desirable to provide other cigarette wrapper configurations which overcome the problems discussed above. Furthermore, it would be desirable to be able to provide apparatus and methods that can efficiently produce such wrappers.

SUMMARY OF THE INVENTION

It is an object of this invention to provide a smoking article wrapper which can modify the burn characteristics of a smoking article. It is also an object of this invention to provide such wrappers which, when used to make cigarettes, provide a cigarette with the further advantage of looking, feeling, tasting and burning like a conventional cigarette when being drawn on by the smoker at normal intervals. In addition, it is an object of this invention to be able to produce such wrappers with an apparatus and method which is feasible to implement. Furthermore, it is an object of this invention to provide apparatus and methods which produce such wrappers for use in on-line cigarette making operations.

In accordance with the present invention, there is provided an apparatus for applying a plurality of regions of a particulate material onto a base web material, the apparatus comprises: means for advancing the base web material along a travel path from an adhesive-applying position to a dusting position; means for applying adhesive to the base web material at the adhesive-applying position; and means for dusting the particulate material onto an advanced base web material at the dusting position. This apparatus can be used to fabricate a smoking article wrapper.

In addition, a method for applying a plurality of regions of a particulate material onto a base web material is provided. This method comprises the steps of: advancing the base web material along a travel path from an adhesive-applying position to a dusting position; applying an adhesive to the base web material at the adhesive-applying position; and dusting the particulate material onto an advanced base web material at the dusting position. As with the apparatus, this method can be used to fabricate a smoking article wrapper.

Furthermore, in accordance with the present invention, there is provided a smoking article wrapper comprising a base web material having a first burn rate and one or more regions having a second burn rate, wherein the regions further comprise a composite layer structure of: the base web material; an adhesive layer which adheres to the base web material; and a layer of particulate material which adheres to the adhesive layer and is supported by the adhesive layer and the base web material. This smoking article wrapper can be incorporated into a smoking article comprising a tobacco column and the smoking article wrapper.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

In accordance with the apparatus of this invention, a reel of cigarette paper (base web) is unwound and advanced first past an adhesive-applying station and then past a dusting station. At the adhesive-applying station one or more regions of adhesive are applied to the base web. Subsequently at the dusting station, particulate material of paper or other matter (hereinafter referred to as "powder") are made to uniformly adhere to the adhesive regions defined by the adhesive-applying station. The reel of base web is then rewound beyond the dusting station, or is allowed to run directly into a cigarette making machine.

Figure 1A:
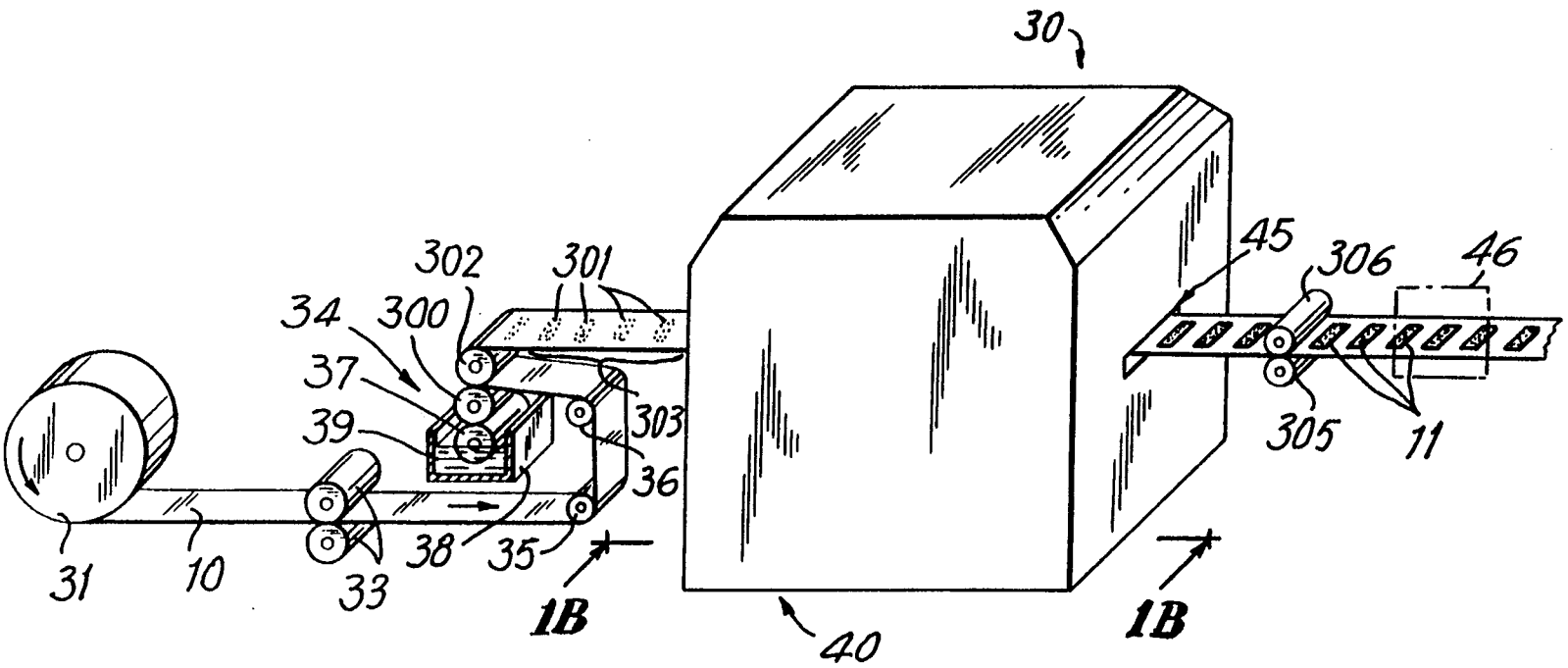
FIG. 1A is a schematic perspective view of a first embodiment of apparatus according to the present invention, for applying a single row of regions of particulate material to a base web at a dusting station.

A first embodiment 30 of the apparatus according to the invention is illustrated schematically in FIG. 1A. Base web 10, which has a width slightly greater than the circumference of a cigarette, is pulled from supply roll 31 by metering rollers 33. Base web 10 passes around rollers 35 and 36 and through a means for applying adhesive which includes adhesive-applying station 34 where a plurality of adhesive regions 301 are applied to the surface of base web 10. At station 34, base web 10 passes between and in contact with adhesive applying roller 300 and smooth roller 302. Adhesive applying roller 300 is, in turn, in contact with smooth roller 37 which is journaled in a bath 38 of adhesive 39. Roller 37 picks up adhesive from bath 38 and transfers it onto the surface of adhesive applying roller 300. The surface of adhesive applying roller 300 has a plurality of raised areas or lands (not shown) and depressed areas (also not shown). As is well-known in the art, such a roller can be used to apply liquid materials to webs that pass over it in desired regions by arranging the dimensions of the lands to correspond to the desired dimensions of the regions of application, and arranging the depressed areas between the lands to correspond to the desired spacing between the regions. Thus, the lands of adhesive applying roller 300 pick up adhesive from the surface of roller 37 and transfer it to the desired adhesive regions 301 on base web 10, which is pressed against roller 300 by pressure from smooth roller 302.

It will be understood by those of skill in the art that other apparatus and methods for applying adhesive can be employed with the present invention. The only constraint on the configuration of adhesive-applying station 34 is that it be able to define two types of regions on the base web: regions with adhesive applied and regions without adhesive. Similarly, the only constraint on the particular form of adhesive employed in station 34 is that it must allow for the adhesion of the selected particulate matter to the base web of a smoking article and that it is compatible for use in a smoking article adhesive-applying station. Preferably, adhesive 39 is the same type as used for the side seams of convention cigarettes.

It also should be understood that although adhesive regions 301 can be covered 100 percent by adhesive, this is not necessary. In accordance with the present invention, adhesive regions 301 can be covered by a pattern of adhesive where the total adhesive coverage within the boundaries of adhesive regions 301 is less than 100 percent. This would be the case, for example, if a cross-hatch pattern of adhesive is applied to regions 301. A second example would be a pattern that has a plurality of small oval-shaped regions, within regions 301, and where there is no adhesive present within the ovals.

The thickness of the layer of adhesive should be chosen to minimize the amount of adhesive employed while still maintaining a sufficient amount to enable particulate material of desired thickness to adhere to the base web and alter the composite burn rate of the powdered regions. Preferably, the thickness is in the range of approximately 0.0002 inches to 0.0003 inches.

Referring back to FIG. 1A, at a distance 303 from pressure roller 302, selected so that some of the volatiles have been removed from adhesive regions 301 but the adhesive has not fully cured, is dusting station 40. FIG.

1B shows a schematic cross sectional view of dusting station 40 through line 1B—1B of FIG. 1A. At dusting station 40, particulate material is uniformly distributed onto regions 301 on base web 10 by way of paddle wheel 42. Paddle wheel 42 rotates so as to cause a cloud of uniform density of particulates to be generated in dusting station 40. Particulate material 43 settles upon the top surface of base web 10 in a uniform manner. Particulate material which settles on base web 10 in an adhesive region 301 will adhere thereto. Paddle wheel 42 also agitates base web 10 to cause particulate material 43, which has not yet adhered to an adhesive region 301 (i.e., particulates which have landed in between adhesive areas, or particulates which have landed on an adhesive area but have not sufficiently adhered to base web 10.), to redistribute on base web 10 and produce uniformly distributed particulates on adhesive region 301.

While adhesive regions 301 pass through dusting station 40, there are two predominant factors which will determine the resulting density of particulates that adhere to adhesive regions 301 (i.e., the percent of coverage of the glue with particulates): the linear velocity of base web 10 through dusting station 40 and the density of the cloud of particulates in dusting station 40. The numerical values for these two factors should be chosen so that the resulting density of particulates that adhere to adhesive regions 301 provide the particular composite burn rate that is desired in the regions which are covered with particulates. Preferably, however, the linear velocity of base web 10, which is controlled by the advancing means (rollers 33 in FIG. 1A), should be in the range from about 4 m/sec. to about 8 m/sec. Furthermore, the density of the cloud of particulates in dusting station 40 should preferably be large enough so that the resulting composite burn rate is not limited by the density of the cloud in station 40, nor by the linear base web velocity, but by the physical characteristics of the particulate matter (i.e., size, weight, surface smoothness, etc.) being applied and the characteristics of the adhesive (i.e., adhesive strength, surface smoothness, etc.). Under these preferred conditions, the resulting composite burn rate will not be a function of the mechanical set-up of the apparatus (i.e., velocities, cloud densities, etc.) but solely a function of the particular properties of the particulate matter being applied and the adhesive being used.

Dusting station 40 includes means for removing unadhered particulate material 44 which serves the purpose of removing unadhered particulates from the top and bottom surfaces of base web 10 prior to exiting dusting station 40 through exit port 45. Removal means 44 can vacuum excess material from base web 10 and replace it in dusting station 40. Removal means 44 also can be made to work by blowing air onto the surfaces of base web 10, as would be apparent to those of skill in the art.

After excess particulate material has been removed from the surfaces of base web 10 by removal means 44, powdered regions 11 of paper web 10 then exit dusting station 40 through exit port 45 (FIG. 1A). If needed, stabilizing rollers 305 and 306 can be included adjacent to exit port 45. The base web, complete with powdered regions 11, is then ready to be fed into a cigarette maker machine (not shown in FIG. 1). If necessary, however, prior to this step, the powdered regions can be sent through a drying means 46 (FIG. 1A) in order to facilitate complete drying of the adhesive layer. Such drying can accomplished by using any conventional drying method known to those skilled in the art. Furthermore, in another embodiment of the present invention, the drying means can be incorporated into dusting station 40 prior to exit port 45, if desired.

In the alternative, after powdered regions exit dusting station 40, base web 10, complete with dried powdered regions, can be rewound beyond dusting station 40 so as to be used at a future time.

Figure 2B:
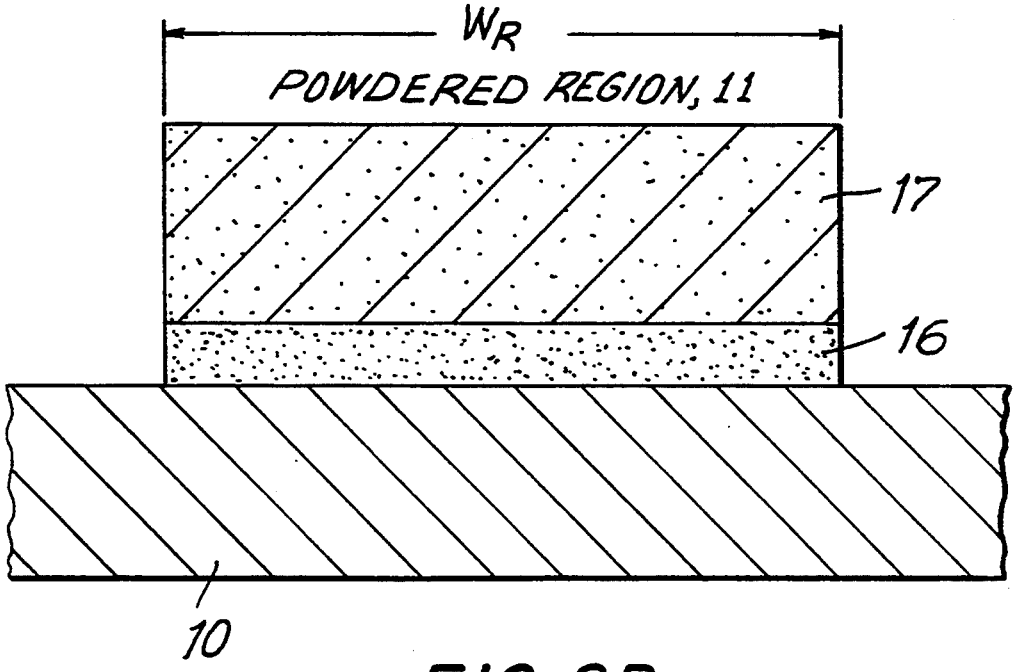
FIG. 2B is a cross-sectional view taken through a region of particulate material 11 along line 2B of FIG. 2A.
Figure 2A:
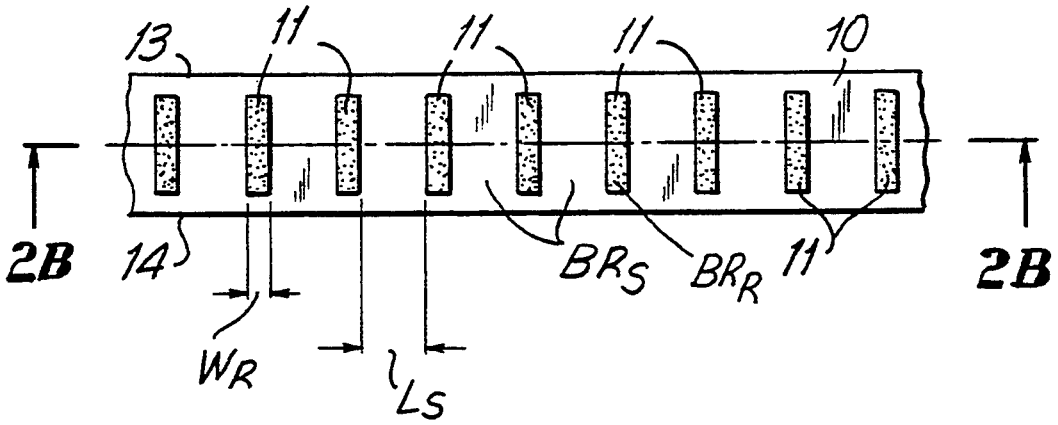
FIG. 2A is a plan view of a single-width cigarette base web having regions of particulate material applied thereto in accordance with the present invention.

The resulting web of smoking article wrapper is shown in FIGS. 2A and 2B. FIG. 2A shows a plan view of a single-width strip of base web 10 to which a plurality of parallel powdered regions 11, have been applied. FIG. 2A shows regions 11 to be parallel rectangular strips, which is preferred, but it is understood that many configurations of regions 11 may be applied to achieve the desired burn rate characteristics. FIG. 2B shows a corresponding cross-sectional view taken through a powdered region 11 along line 2B—2B of FIG. 2A. Powdered region 11 is composed of a composite three-layer structure consisting of: base web 10; adhesive layer 16 for adhering a layer of particulate material 17 to base web 10; and the layer of particulate material 17. In the preferred embodiment depicted in FIG. 2A, powdered regions 11 have a width $W_R$ and are separated from each other by a length $L_S$. They are also characterized by a composite burn rate of $BR_R$ corresponding to the burn rate of the three-layer structure consisting of base web 10, adhesive layer 16, and particulate material layer 17. In contrast, the non-powdered regions, in between the powdered regions, are characterized by a burn rate of $BR_S$, corresponding to the burn rate of base web 10.

In accordance with the present invention, $W_R$ can be greater than or less than $L_S$ even though FIG. 2A shows $W_R$ as being smaller than $L_S$. Furthermore, $BR_R$ can also be greater than or less $BR_S$, depending upon the function and purpose of base web 10 when it is incorporated into a cigarette. Accordingly, a cigarette incorporating base web 10 may have either one or more powdered regions 11 of width $W_R$ and burn rate of $BR_R$.

If base web 10 with powdered regions 11 serve to significantly reduce the burn rate of a cigarette if it has not been drawn on by the smoker, then preferably $W_R$ should be 5 mm and $L_S$ should be in the range from about 12 mm to about 20 mm, preferably 15 mm. Accordingly, the base web, with burn rate $BR_S$, should be a conventional cigarette paper with a conventional burn rate and the burn rate $BR_R$ of powdered regions 11 should be chosen to be less than $BR_S$ so that the cigarette will have a reduced burn rate if it is not drawn on by the smoker.

When base web 10 is formed into a cigarette, it is rolled about longitudinal axis 2B (see FIG. 2A) so that edges 13 and 14 overlap. Edges 13 and 14 are then glued together to form a cigarette tube, or rod, containing tobacco. To assure a good seal when edges 13 and 14 are glued, powdered regions 11 are preferably shorter than the width of base web 10, so that the ends of regions 11 do not interfere with the overlap of edges 13 and 14. As stated above, base web 10 could be run directly into a cigarette making machine after powdered regions 11 are applied, or it could be rewound for later use.

Powdered regions 11 of the present invention include a layer of particulates of material 17 which can alter the mass burn rate of the cigarette in which it is incorporated into. The material can be any material which can be finely divided into particulates and which can be dusted onto a base web. These materials include, but are not limited to, paper, cloth, or any synthetic material which can be incorporated into a cigarette. These materials also include particulates of burn promoters or inhibitors which are used to alter the burn rate of cigarette paper. For these type of materials, the only requirement is that the material must be able to be put into a particulate form so that it can be dusted onto a base cigarette web. In addition to dusting these particulates directly onto the base web, they can also be incorporated into paper or other material which is then pulverized into particulate form wherein the combination is then dusted onto the base web.

Preferably, the particulate material of the present invention should have a size in the range from about 0.1 micrometers to about 2 micrometers. Any method to produce the particulated material can be used, but preferably, if the particulate material is paper, pulverization should be used.

In accordance with the present invention, it can be seen that the "alignment" of the particulate material to the base web is limited only by the adhesive-applying step. This is in contrast to other methods where patches of a first material are applied to a web material where both the adhesive-applying step and the patch-attaching step contribute to the final alignment of the patch to the web edge. In such methods, even if the adhesive strip is applied perpendicular to the base web edge, if the patch is not, then the final product will not have an "aligned" burn rate-altering region. Analogously, if the patch is not aligned to the adhesive strip, so that they overlap each other, then the patch may not at all adhere to the base web. Furthermore, any misalignment of the patch to the adhesive strip can result in "exposed" adhesive which is not covered by patch material and patch material which does not have adhesive under it.

For the above reasons, both the adhesive-applying step and the patch-attaching step had to be aligned to the base web edge in prior methods. Furthermore, and more importantly, these steps had to be aligned to each other in order for the adhesive to be accurately aligned to the patch material. In accordance with the present invention, these problems are minimized because only the adhesive-applying step has to be aligned to the base web. The step in which the particulate material is attached to the adhesive region is inherently "self-aligning." The "self-aligning" nature of the present invention allows for apparatus'and methods which are inherently less complex than prior methods.

Figure 1B:
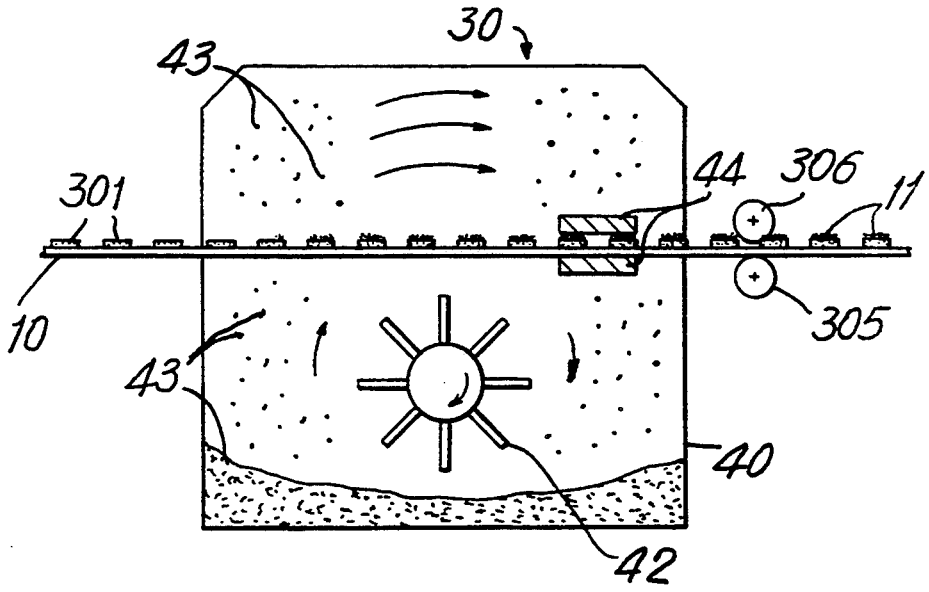
FIG. 1B is cross-sectional view of dusting station 40 in FIG. 1A through line 1B—1B.
Figure 3:
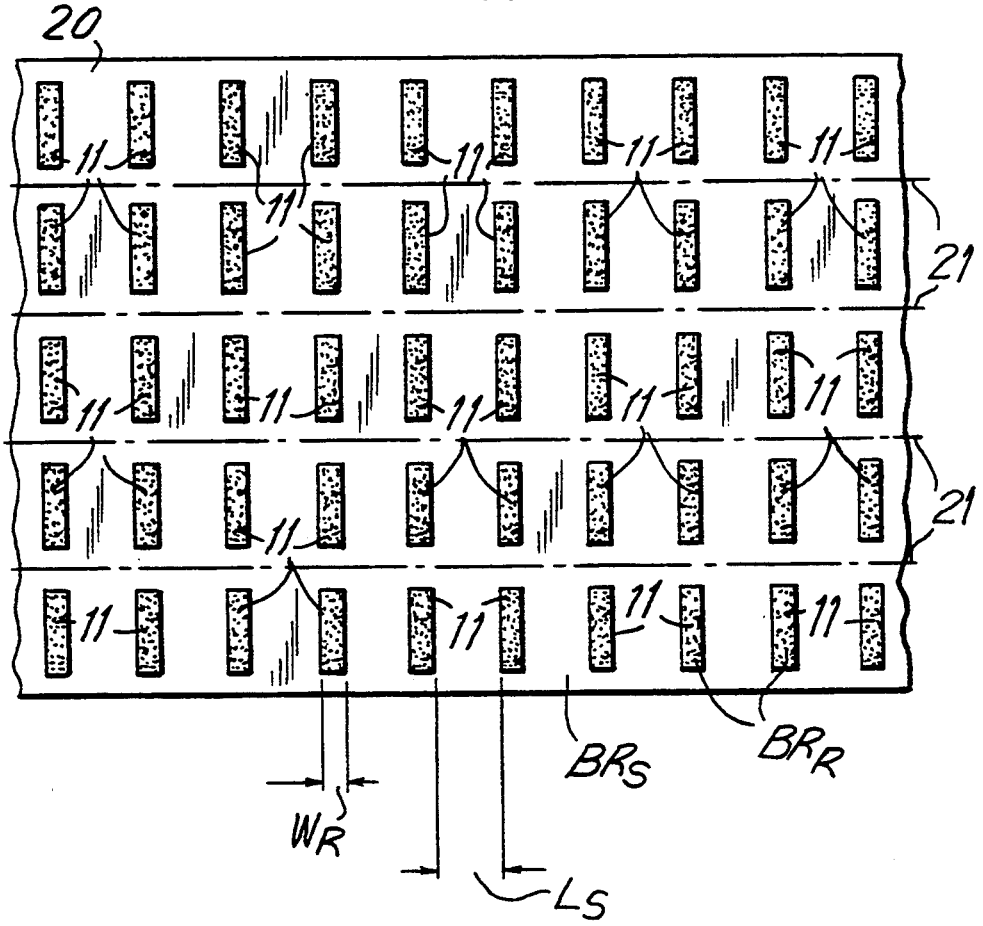
FIG. 3 is a plan view of a multiple-width cigarette base web having regions of particulate material applied thereto in accordance with the present invention.

The number of rows of powdered regions applied at the dusting station can be as little as one (as shown in FIGS. 1A, 1B and 2A), which is preferable in an on-line application, or as many as, preferably, five or six, or more. Accordingly, the base web could be the width of a single strip of cigarette paper, as in on-line applications, or, preferably, the width of multiple strips of cigarette paper, as in off-line applications. Such a multi-strip embodiment is shown in FIG. 3 which depicts a wider base web 20 to which multiple rows of powdered regions 11 have been applied. Base web 20 will most likely be rewound and then severed along lines 21 to form individual reels of cigarette paper for use in cigarette making machines. However, it may be possible to separate base web 20 into individual strips for use directly in cigarette making machines on-line.

Figure 4:
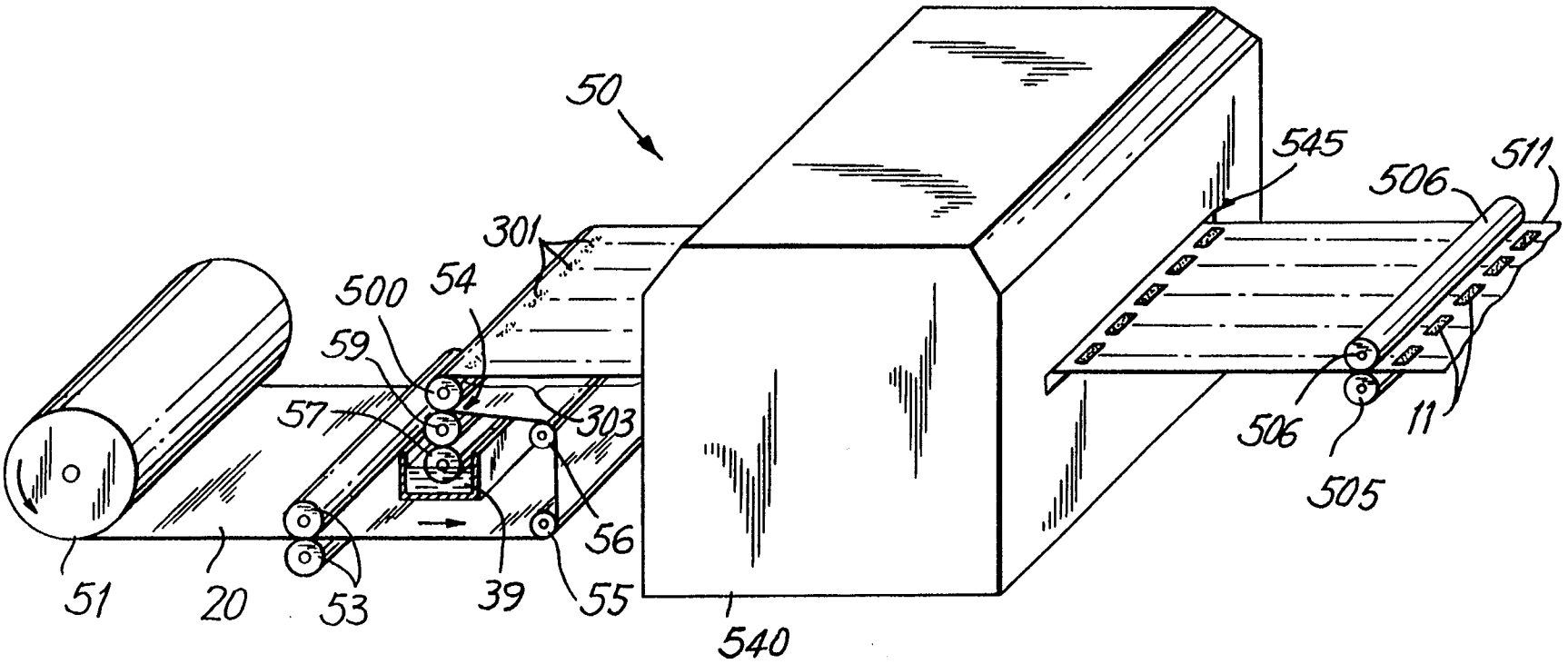
FIG. 4 is a schematic perspective view of a second embodiment of apparatus according to the present invention, for applying a plurality of rows of regions of a particulate material to a base web at a dusting station.

A second embodiment of apparatus according to the invention is shown schematically in FIG. 4 which is designed to accommodate the multi-strip design discussed above. Apparatus 50 operates similar to single-strip apparatus 30, except that it powders multiple rows of regions 11 onto base web 20. Accordingly, supply roll 51 is wider than single-strip supply roll 31 of apparatus 30. Similarly, metering rollers 53 are wider than metering rollers 33; rollers 57, 59 and 500, as well as bath 58, of adhesive-applying station 54 are wider than rollers 37, 300, 302 and bath 38 of adhesive-applying station 34; rollers 55 and 56 are wider than corresponding rollers 35 and 36; and the paddle wheel (not shown) and the dust removal means (not shown) are wider than corresponding paddle wheel 42 and dust removal means 45. As with apparatus 30, apparatus 50 can include a drying means to facilitate complete drying of the adhesive layer prior to cigarette fabrication, as discussed above.

Powdered base web 511 is rewound onto a take-up roll (not shown) for later cutting into individual reels for use on cigarette making machines. Alternatively, powdered base web 511 might be cut on-line by slitters and fed directly to a number of different cigarette making machines.

Figure 5A:
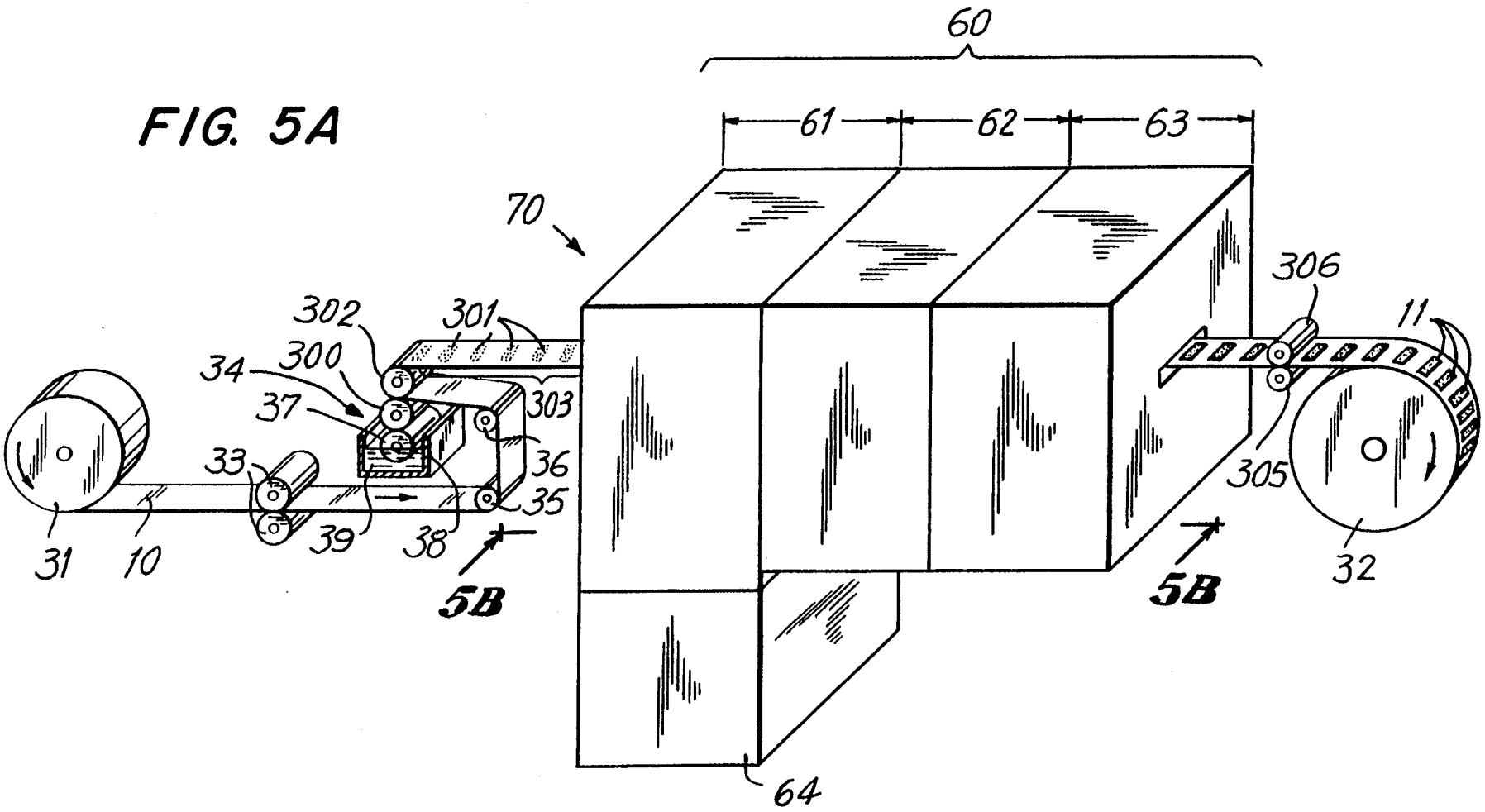
FIG. 5A is a schematic perspective view of a third embodiment of apparatus according to the present invention, for applying a single row of regions of a particulate material to a base web at a dusting station.
Figure 5B:
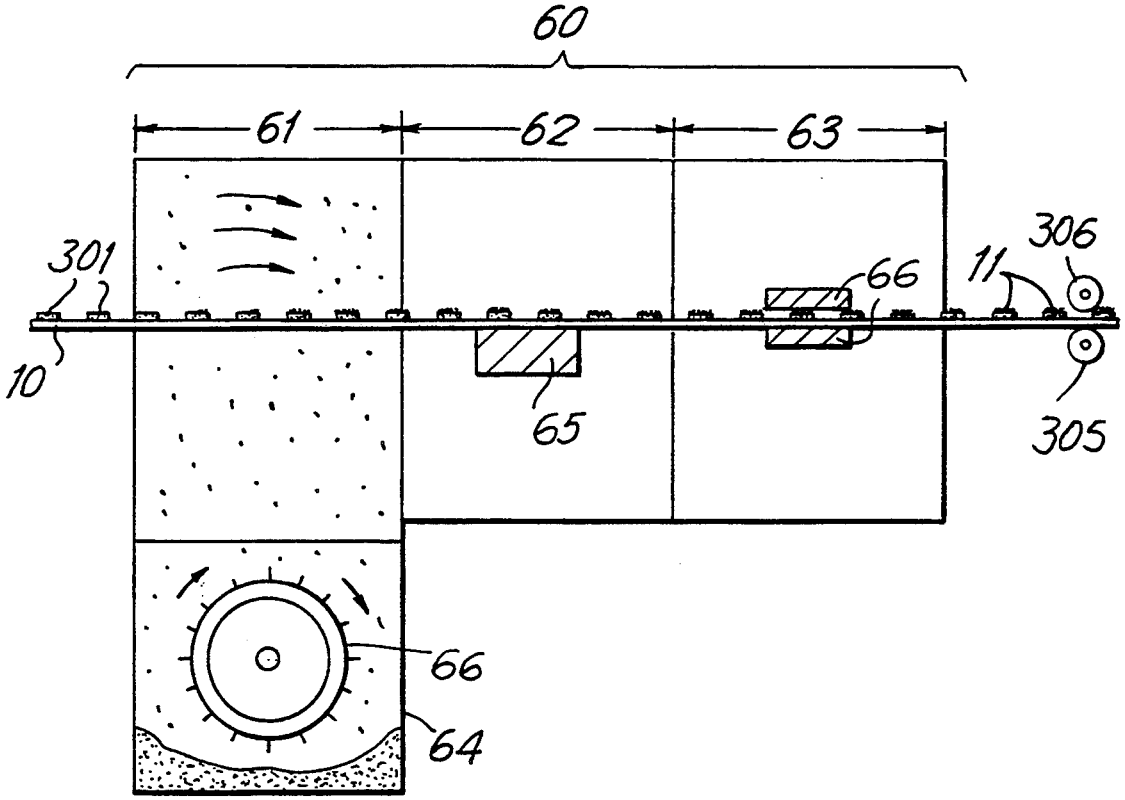
FIG. 5B is a cross-sectional view of segmented ducting station 60 in FIG. 5A through line 5B—5B.

A third embodiment of apparatus 70 according to this invention is illustrated in FIGS. 5A and 5B which operates similar to apparatus 30 in FIG. 1A except that dusting station 40 of apparatus 30 is replaced with segmented dusting station 60. Segmented dusting station 60 includes powdering station 61, agitation station 62 and powder removal station 63. FIG. 5B is a schematic cross-sectional view of segmented dusting station 60 through line 5B—5B of FIG. 5A.

In FIG. 5A after base web 10 rolls through adhesive-applying station 34, regions 301 are then run through segmented dusting station 60, where regions 301 first encounter powdering station 61. This station includes fan 66 in housing 64 for blowing air, or other inert gaseous medium, so as to generate an aerial current of particulates of paper or other material. These particulates are suspended in the air by fan 66 and are thus rapidly moved about the station to form an aerial current. These particulates eventually collect on adhesive regions 301 where the powdered regions then move into agitation station 62.

It should be understood that fan 66 can be replaced with any other apparatus which is capable of generating an aerial current of particulates. Such apparatus' include, but are not limited to, nozzles through which high-pressure air is forced and electrostatic devices.

Agitation station 62 includes a vibrator 65 (FIG. 5B) which agitates base web 10 so as to cause the particulates which have collected on base web 10 to redistribute if they have not adhered to an adhesive region. This redistribution provides for more uniformly powdered adhesive regions. A second purpose of the agitation is also to break up coagulated particulates on base web 10 so as to further improve uniformity.

It should be understood that vibrator 65 of agitation station 62 can be replaced with any other apparatus that can cause redistribution of the particulates. Such apparatuses include, but are not limited to, paddle wheels and agitators. Another possible mechanism for agitation would be to employ forced air that is blown onto the top or bottom surface of base web 10.

Regardless of the mechanism is used to agitate and redistribute the particulates on the surface of base web 10, in agitation station 62, the powdered and redistributed regions then move into powder removal station 63 where unadhered particulates are removed from the top and bottom surfaces of base web 10 by apparatuses 66. This type of apparatus includes, but is not limited to, apparatuses which operate by suction, gravity, deflection, rotary brush assemblies or a combination thereof.

If necessary, powder removal station 63 can include a dryer (not shown), as discussed above, for enabling the adhesion region to fully dry prior to rewounding on reel 32 or, if used in an on-line process, prior to cigarette fabrication.

It should be understood that although FIGS. 5A and 5B show a "segmented" dusting station with three individual stations, these stations can be condensed into one where the three functions are all performed within a single station, as was the case for the embodiments shown in FIGS. 3 and 4.

Figure 6:
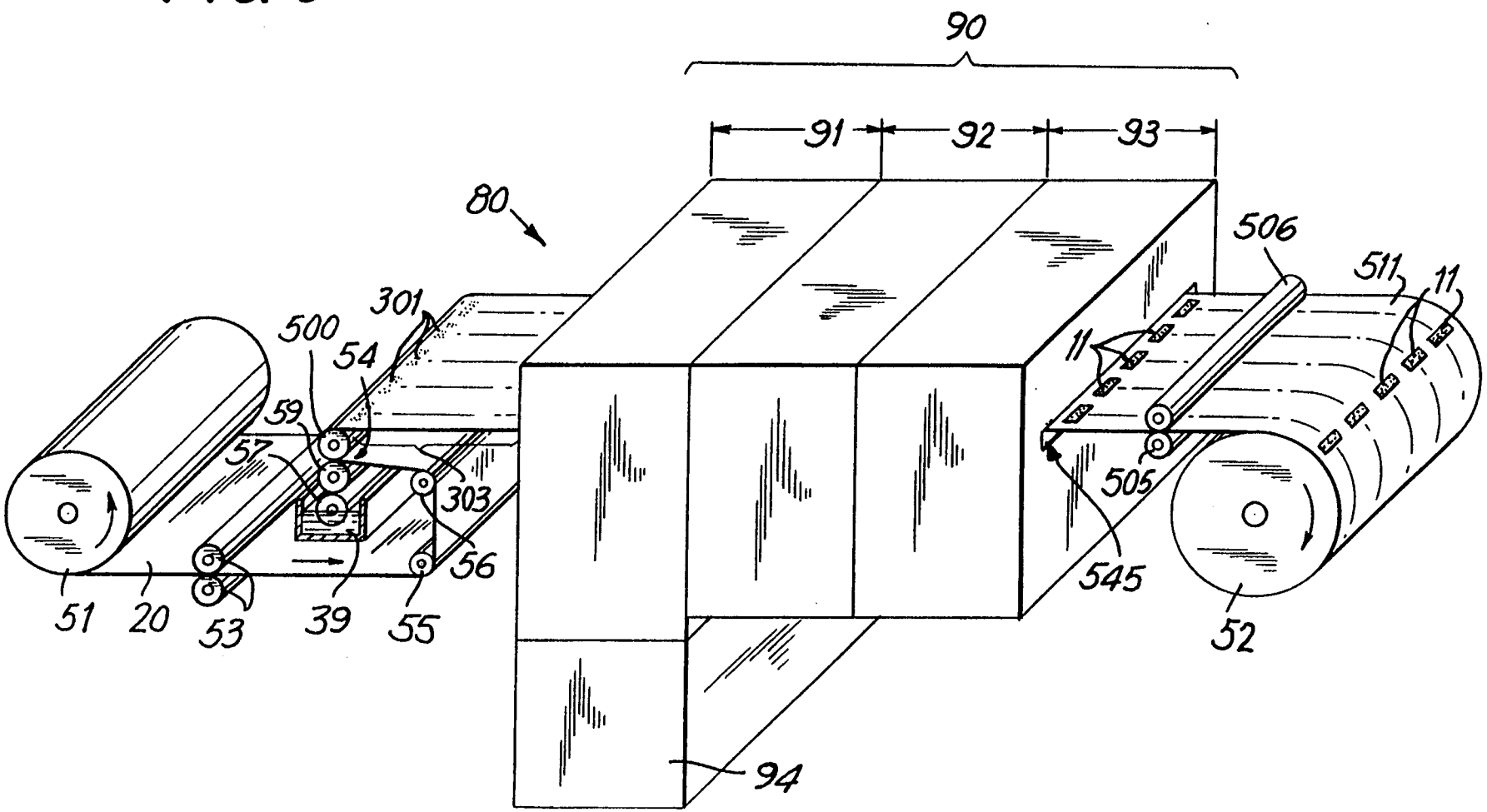
FIG. 6 is a schematic perspective view of a fourth embodiment of apparatus according to the present invention, for applying a plurality of rows of regions of a particulate material to a base web at a dusting station.

A fourth embodiment of apparatus 80 according to this invention is illustrated in FIG. 6 which operates similar to apparatus 70 in FIG. 5 except that it powders multiple rows of regions 11 onto base web 20. Accordingly, supply and take-up rolls 51 and 52 are wider than single-strip supply roll 31 of apparatus 70. Similarly, metering rollers 53 are wider than metering rollers 33; rollers 57, 59, and 500, as well as bath 58, of adhesive-applying station 54 are wider than rollers 37, 300, and 302 and bath 38 of adhesive applying station 34; rollers 55 and 56 are wider than corresponding rollers 35 and 36; and powdering station 91, agitation station 92 and powder removal station 93 are wider than corresponding powdering station 61, agitation station 62 and powder removal station 63.

As above, powdered base web 511 is rewound onto take-up roll 52 for later cutting into individual reels for use on cigarette making machines. Alternatively, as above, base web 511 might be slit on-line by slitters and fed directly to a number of different cigarette making machines, assuming that dusting station 90 can operate quickly enough.

Thus it can be seen that apparatus and a method for accurately and efficiently applying regions of a particulate material to a base web material, so as to affect the mass burn rate of a cigarette, without the need for complex machinery is provided. Such apparatus and method are able to circumvent the "alignment" difficulties which inherently exist when one type of material is applied onto another. The apparatus and method produce a wrapper for use in a smoking article wherein the burn rate of the article is modified.

One skilled in the art will appreciate that the present invention can be practiced by other than the described embodiments, which are presented for purposes of illustration and not of limitation, and the present invention is limited only by the claims which follow.

What is claimed is:

1. A smoking article wrapper which modifies the burn characteristics of a smoking article made therefrom, comprising a base web material having a first burn rate and one or more regions having a second burn rate, wherein said regions further comprise a composite layer structure of:

said base web material;

an adhesive layer applied to said base web material; and a layer of particulate material subsequently applied to said adhesive layer for adhering said particulate material to said base web material.

2. The smoking article wrapper of claim 1 wherein said particulate material comprises cigarette paper.

3. The smoking article wrapper of claim 2 wherein the particulate cigarette paper is treated with a burn promoter to alter the burn rate of said smoking article.

4. The smoking article wrapper of claim 3 wherein said particulate material comprises of particulates having a size ranging from about 0.1 microns to about 2 microns.

5. The smoking article wrapper of claim 2 wherein the particulate cigarette paper is treated with a burn inhibitor to alter the burn rate of said smoking article.

6. The smoking article wrapper of claim 5 wherein said particulate material comprises of particulates having a size ranging from about 0.1 microns to about 2 microns.

7. The smoking article wrapper of claim 2 wherein said particulate material comprises of particulates having a size ranging from about 0.1 microns to about 2 microns.

8. The smoking article wrapper of claim 1 wherein said particulate material comprises a material used to alter the burn rate of cigarette paper.

9. The smoking article wrapper of claim 8 wherein said particulate material comprises of particulates having a size ranging from about 0.1 microns to about 2 microns.

10. The smoking article wrapper of claim 1 wherein said one or more regions are substantially rectangular.

11. The smoking article wrapper of claim 10 wherein said smoking article wrapper is a parallelogram having first and third parallel edges of greater length than second and fourth parallel edges and wherein one or more of said regions extend substantially perpendicular to the first and third parallel edges.

12. A smoking article with modified burn characteristics, comprising a tobacco column and a smoking article wrapper, said wrapper comprising a base web material having a first burn rate and one or more regions having a second burn rate, wherein said regions further comprise a composite layer structure of:

said base web material;

an adhesive layer applied to said base web material; and a layer of particulate material subsequently applied to said adhesive layer for adhering said particulate material to said base web material.

13. The smoking article of claim 12 wherein said particulate material comprises cigarette paper.

14. The smoking article of claim 13 wherein the particulate cigarette paper is treated with a burn promoter to alter the burn rate of said smoking article.

15. The smoking article wrapper of claim 14 wherein said particulate material comprises of particulates having a size ranging from about 0.1 microns to about 2 microns.

16. The smoking article of claim 13 wherein the particulate cigarette paper is treated with a burn inhibitor to alter the burn rate of said smoking article.

17. The smoking article wrapper of claim 16 wherein said particulate material comprises of particulates having a size ranging from about 0.1 microns to about 2 microns.

18. The smoking article wrapper of claim 13 wherein said particulate material comprises of particulates having a size ranging from about 0.1 microns to about 2 microns.

19. The smoking article of claim 12 wherein said particulate material comprises a material used to alter the burn rate of cigarette paper.

20. The smoking article wrapper of claim 19 wherein said particulate material comprises of particulates having a size ranging from about 0.1 microns to about 2 microns.

21. The smoking article of claim 12 wherein said one or more regions are substantially rectangular.

22. The smoking article of claim 21 wherein said smoking article wrapper is a parallelogram having first and third parallel edges of greater length than the second and fourth parallel edges and wherein one or more of said regions extend substantially perpendicular to the first and third parallel edges.

* * * * *